US006632406B1

(12) United States Patent
Michelin et al.

(10) Patent No.: US 6,632,406 B1
(45) Date of Patent: Oct. 14, 2003

(54) DEVICE FOR REMOVING POLLUTION FROM EXHAUST GASES

(75) Inventors: Joël Michelin, Dampierre les Bois (FR); Jean-Pierre Barnabé, Valentigney (FR)

(73) Assignee: Ecia Industrie, Boulogne (FR)

( * ) Notice: Subject to any disclaimer, the term of this patent is extended or adjusted under 35 U.S.C. 154(b) by 0 days.

(21) Appl. No.: 09/459,607

(22) Filed: Dec. 13, 1999

(30) Foreign Application Priority Data

Dec. 14, 1998 (FR) ..... 98 15773

(51) Int. Cl.[7] ..... B01D 53/34

(52) U.S. Cl. ..... 422/178; 422/168; 422/169; 422/176; 422/177; 422/179; 422/180; 422/181; 422/211; 422/217; 422/221; 422/222; 422/223

(58) Field of Search ..... 422/168, 169, 422/176, 177, 178, 179, 180, 181, 211, 217, 221, 222, 223

(56) References Cited

U.S. PATENT DOCUMENTS 4,032,310 A * 6/1977 Ignoffo ..... 55/276
4,246,235 A * 1/1981 Rogers ..... 422/198
4,444,725 A * 4/1984 Feaster ..... 422/180
4,576,617 A * 3/1986 Renevot ..... 55/96
5,488,826 A * 2/1996 Paas ..... 422/179
5,922,291 A * 7/1999 Hanfling et al. ..... 422/211

FOREIGN PATENT DOCUMENTS

| | | |
|---|---|---|
| DE | 38 15 148 | 11/1989 |
| EP | 405 310 | 6/1990 |
| EP | 674 098 | 3/1995 |
| WO | 99 10632 | 3/1999 |

* cited by examiner

*Primary Examiner*—Glenn Caldarola
*Assistant Examiner*—Basia Ridley
(74) *Attorney, Agent, or Firm*—Sughrue Mion PLLC

(57) ABSTRACT

The device for removing pollution from the exhaust gases of an internal combustion engine includes an exhaust box (12) containing, in series, a catalytic purification unit (18) and a particle filter (20). The exhaust box (12) includes means (36; 60) providing access to the upstream face of the particle filter (20). Application to removing pollution from automobile vehicle diesel engines in particular.

11 Claims, 4 Drawing Sheets

DEVICE FOR REMOVING POLLUTION FROM EXHAUST GASES

BACKGROUND OF THE INVENTION

The present invention concerns a device for removing pollution from the exhaust gases of an internal combustion engine, of the type including an exhaust box containing, in series, a catalytic purification unit and a particle filter.

Such devices are used to remove pollution from automobile vehicle diesel engines in particular. The catalytic purification unit is adapted to treat pollutant emissions in the gas phase and the particle filter is adapted to retain particles of soot emitted by the engine.

The particle filter operates in accordance with a succession of filtration and regeneration phases. During filtration phases particles of soot emitted by the engine are deposited on the upstream face of the filter. During the regeneration phase the particles of soot, consisting essentially of carbon, are burned on the upstream face of the filter, in order to restore the latter's original properties.

To favor the regeneration of the particle filter it is necessary to incorporate in the fuel feeding the engine a chemical agent which reduces the combustion temperature of the soot. The chemical agent is a catalytic additive containing one or more metallic constituents in the form of organometallic compounds. These burn in the combustion chamber of the engine and are deposited in the form of oxides within the particles of soot on the upstream face of the particle filter.

During phases of regeneration of the particle filter the metallic oxide residues, usually referred to as ash, are retained on the upstream face of the particle filter. Accordingly, during prolonged use of the pollution removing device, the accumulated ash significantly reduces the properties of the particle filter and in particular its ability to be regenerated. For a pollution removing device installed on a diesel-engined vehicle, deterioration of the properties of the particle filters has been observed at mileages exceeding 50,000 km.

Existing vehicles require replacement of the entire pollution removing device, which is a lengthy and costly operation.

SUMMARY OF THE INVENTION

The object of the invention is to propose a pollution removing device which reduces maintenance and service costs and guarantees satisfactory operation of the particle filter integrated therein over a long period.

To this end, the invention consists in a device for removing pollution from the exhaust gases of an internal combustion engine, of the aforementioned type, characterized in that the exhaust box includes means providing access to the upstream face of the particle filter, which access means have a cross section sufficient to enable cleaning of the particle filter by removal of ash retained on the upstream face of the filter.

In particular embodiments of the invention, the pollution removing device has one or more of the following features:

- it includes means providing access to the downstream face of the particle filter;
- the exhaust box has an outer jacket delimiting an exhaust gas flow passage across which are disposed the catalytic purification unit and the particle filter, and said access means include an orifice in the outer jacket opening opposite the corresponding surface of the particle filter and a removable cap for blocking said access orifice;
- the exhaust box has an outer jacket delimiting an exhaust gas flow passage across which are disposed the catalytic purification unit and the particle filter and said access means include a transverse interruption of the outer jacket extending all around its periphery, which interruption separates the outer jacket into two successive sections, and means for removably butt jointing two successive sections at said interruptions;
- the removable connecting means include, at the facing ends of each section, peripheral flanges and a clip for axially clamping the two flanges together;
- said peripheral flanges are formed by deforming the ends of the successive sections;
- the removable connecting means include a clamping ring attached to the end of each section and bolts for clamping the two clamping rings;
- the free cross section of the transverse interruption is more than 60% of the cross section of the corresponding face of the particle filter;
- the free section of the transverse interruption is greater than the maximum section of the particle filter, to enable the latter to be removed;
- the removable butt jointing means include a seal disposed between the two successive sections.

BRIEF DESCRIPTION OF THE DRAWINGS

The invention will be better understood after reading the following description which is given by way of example only and with reference to the drawings, in which.

DETAILED DESCRIPTION OF THE INVENTION

Figure 1:
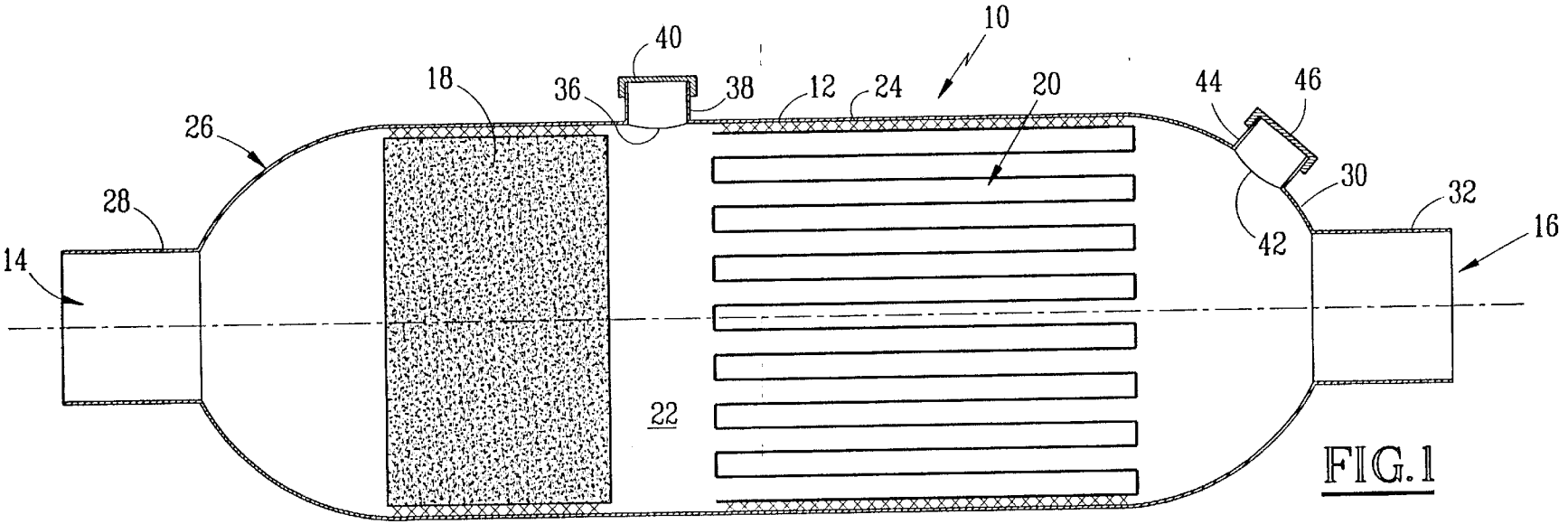
FIG. 1 is a view in longitudinal section of a device in accordance with the invention for removing pollution from exhaust gases.

The pollution removing device 10 shown in FIG. 1 includes an exhaust box 12 containing in series, from an inlet 14 toward an outlet 16, a catalytic purification unit 18 and a particle filter 20 separated by a transition free space 22. The exhaust box 12 has an outer jacket delimiting an exhaust gas flow passage across which the catalytic purification unit 18 and the particle filter 20 are disposed.

The catalytic purification unit 18 is a gas-permeable structure covered with catalytic metals favoring oxidation of the combustion gases and/or reduction of nitrogen oxides, for example.

The particle filter 20 is made from a filter material having a ceramic or silicon carbide monolithic structure of sufficient porosity for the exhaust gases to pass through it. However, as is well known in the art, the diameter of the pores is sufficiently small to retain particles, in particular particles of soot, on the upstream face of the filter. The particle filter can also be made from ceramic or silicon carbide foam. It can also be a cartridge filter or a sintered metal filter.

The particle filter used here includes a set of parallel passages divided into a first group made up of inlet passages and a second group made up of outlet passages. The inlet and outlet passages are disposed in a quincunx arrangement. To clarify the drawings, the cross section of the passages has been increased and their number reduced.

The inlet passages are open in the upstream section of the particle filter and closed in the downstream section of the particle filter.

The outlet passages are closed in the upstream section of the particle filter and open in its downstream section.

The main part of the outer jacket is formed by a cylindrical wall 24 of substantially constant section.

The inlet end of the box includes a divergent section 26 connecting an inlet pipe 28 to the cylindrical wall 24. The rear end of the cylindrical wall 24 is extended by a convergent section 30 terminating in an outlet pipe 32 delimiting the outlet 16.

In accordance with the invention, means are provided on the exhaust box to provide access to the upstream surface of the particle filter 20. In the embodiment of the invention shown in FIG. 1 they comprise an orifice 36 through the cylindrical wall 24 which opens into the free space 22. The orifice 36 is delimited by a tubular flange 38. It is blocked by a removable cap 40.

Similarly, the exhaust box includes means providing access to the downstream face of the particle filter. They are provided on the convergent outlet section 30 and include an orifice 42 through the wall delimiting the convergent section 30. The orifice is delimited by a flange 44 and blocked by a removable cap 46.

Clearly, with a device of the above kind, the particle filter can be cleaned after a particular period of operation of the engine, when the upstream face of the particle filter is soiled with ash, as part of servicing the vehicle.

To this end, the caps 40 and 46 are removed. A nozzle for injecting air or a suitable fluid is inserted into the downstream end of the particle filter through the orifice 42 and a pipe for aspirating the air or fluid is inserted into the upstream end of the particle filter through the orifice 36. Ash on the upstream surface of the filter is removed by the contraflow of air or fluid through the particle filter 20.

The pollution removing device is returned to its original performance specification on replacing the caps 40 and 46.

Figure 2:
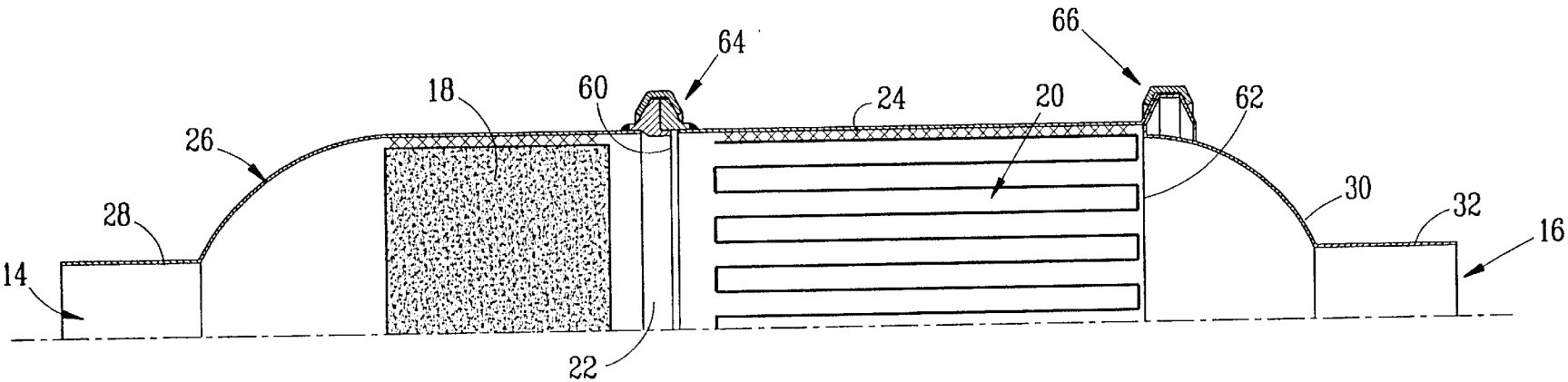
FIG. 2 is a half-view in longitudinal section of another embodiment of a pollution removing device in accordance with the invention.

In the embodiment of the invention shown in FIG. 2 components identical to those shown in FIG. 1 are designated by the same reference numbers.

In this embodiment only the means providing access to the upstream and downstream surfaces of the particle filter 20 are different compared to the first embodiment.

In this embodiment of the invention, the means providing access to the upstream and downstream surfaces of the particle filter each include a transverse interruption in the jacket of the exhaust box, extending all around its perimeter, and removable means for butt jointing the two successive sections defined in this way on respective opposite sides of the interruption.

Accordingly, the exhaust box includes a transverse interruption 60 in the main part of the cylindrical wall 24 level with the free space 22. A second transverse interruption 62 is provided downstream of the particle filter, in the region where the wall 24 joins onto the convergent section 30.

Respective removable means 64, 66 for butt jointing two successive sections are associated with the interruptions 60, 62.

The interruptions 60 and 62 are provided in a region of the outside wall of the exhaust box in which the section of the gas flow passage is substantially equal to the section of the upstream face of the particle filter. Accordingly, removing the connecting means and separating the successive sections on respective opposite sides of the interruption provides manual access to most of the surface of the particle filter.

The gas flow passage section in the region of the interruptions 60, 62 is preferably greater than 60% of the section of the corresponding face of the particle filter, to assure easy access thereto. A section ratio greater than 60% guarantees a good flow of gases in the filter and prevents significant thermal loss.

The free section of the jacket of the exhaust box in the region of the interruption is advantageously made greater than the maximum section of the particle filter, to enable the filter to be removed and replaced via one or other of the interruptions. It is therefore possible to change the particle filter without replacing the other components of the pollution removing device.

FIGS. 3A to 3G show seven different embodiments of the removable connecting means 64 provided at the level of the interruption 60.

Figure 3A:
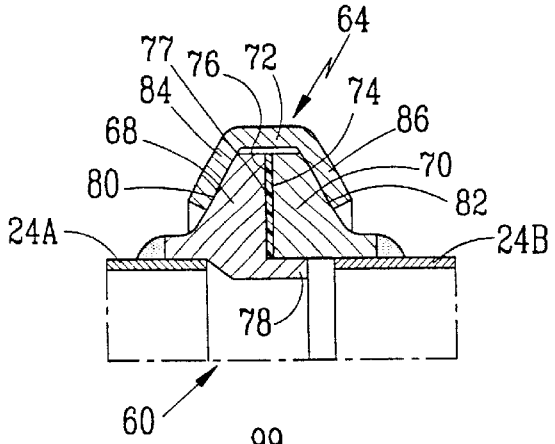
FIGS. 3A, 3B, 3C, 3D, 3E, 3F and 3G are partial views in section of variants of the interruption of the main part of the exhaust box from FIG. 2 between the catalytic purification unit and the particle filter.

In the embodiment shown in FIG. 3A the removable means 64 for butt jointing two successive sections 24A, 24B include two external flanges 68, 70 held together by a clip 72.

The two flanges 68, 70 are welded to the facing ends 24A, 24B. They have respective front bearing surfaces 74, 76 with a gasket 77 between them.

The flange 68 also includes an inner collar 78 adapted to engage inside the flange 70 in a nesting arrangement assuring coaxial positioning of the two sections 24A, 24B.

The thickness of the flanges 68, 70 decreases progressively in the outward direction. They therefore define outwardly convergent ramps 80, 82 on which the clip 72 bears. The latter has a tapered U-shaped cross section. Its two flanges 84, 86 converge towards the base of the U-shape. Their inclinations correspond to those of the ramps 80 and 82, on which they are adapted to bear.

The clip 72 includes circumferential tightening means such as a screw tightener.

When the clip 72 is tightened in the circumferential direction, the radial force applied by the flanges 84, 86 to the ramps 80, 82 produces a cam effect which clamps the two flanges 68, 70 against each other in the axial direction. Thus substantially gastight continuity of the wall 24 is assured at the level of the interruption 60.

Figure 3B:
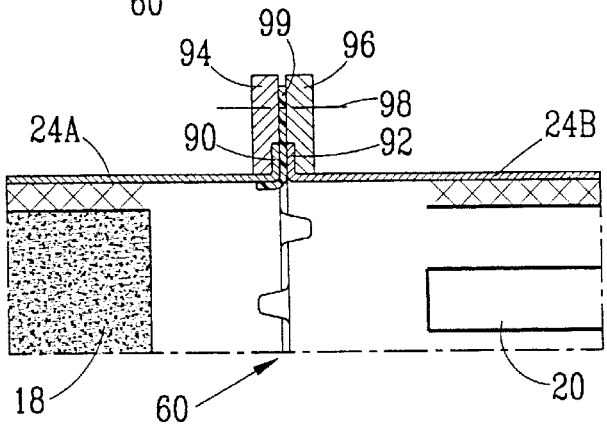

In the embodiment shown in FIG. 3B the facing ends of the section 24A and 24B have external peripheral flanges 90, 92 on which bear respective clamping rings 94, 96 connected together in the axial direction by bolts 98 disposed all around the perimeter of the interruption 60. FIG. 3B shows the axis of one of the bolts 98.

A gasket 99 is disposed between the clamping rings 94 and 96 and the facing surfaces of the flanges 90, 92. The gasket 99 has integral centering tongues 100 at its inside periphery. These tongues are bent parallel to the walls of the sections 24A, 24B. They are deformed alternately towards one and the other of the sections. They therefore assure axial positioning of the two sections 24A, 24B.

In a variant that is not shown the flanges 90, 92 are dispensed with and the clamping rings 94, 96 are welded directly to the cylindrical ends of the sections 24A and 24B.

In each of the embodiments shown in FIGS. 3C to 3G the facing ends of the sections 24A and 24B are deformed radially outward to form peripheral flanges. The removable means for butt jointing two successive sections 24A, 24B include a clip for clamping the two flanges together in the axial direction. This clip, which is identical to the clip 72 of the embodiment shown in FIG. 3A, grips the two flanges and presses them against each other by virtue of a cam effect.

Figure 3C:
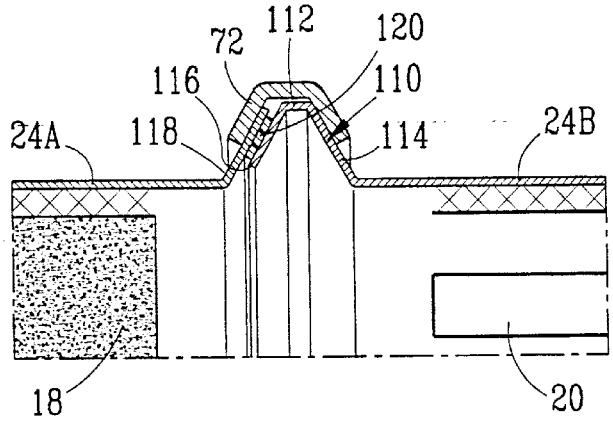

In the embodiment shown in FIG. 3C the flange 110 obtained by deforming the end of the section 24B has a tapered U-shaped cross section which is open on the side facing the inside of the exhaust box. The flange therefore has a bottom portion 112 parallel to the axis of the exhaust box and offset radially outwards. The bottom portion 112 is flanked by two walls 114, 116 diverging from the bottom 112.

The flange 118 at the end of the section 24B is formed by a peripheral deformation thereof. It is parallel to the wall 116. The flange 118 is therefore a frustoconical flange diverging in the direction toward the end of the section 24A.

A gasket 120 is disposed between the walls 116 and 118.

The clip 72 has a tapered U-shaped cross section with two flanges converging towards the base and bears on the wall 114 of the flange 110 and on the flange 118. As in the embodiment shown in FIG. 3A, it presses the sections 24A, 24B together in the axial direction and butt joins them by virtue of a cam effect.

Figure 3D:
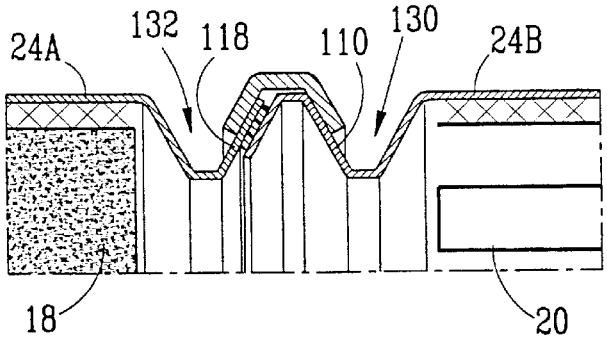

In the embodiment shown in FIG. 3D, the ends of the sections 24A, 24B have flanges 110, 118 of similar shape to those shown in FIG. 3C. However, these flanges are formed at the end of a peripheral constriction 130, 132 on each section 24A, 24B. The flanges 110, 118 therefore lie inside a space defined by the extension of the walls delimiting the sections 24A, 24B, so reducing the overall outside dimensions of the removable connecting means.

Figure 3E:
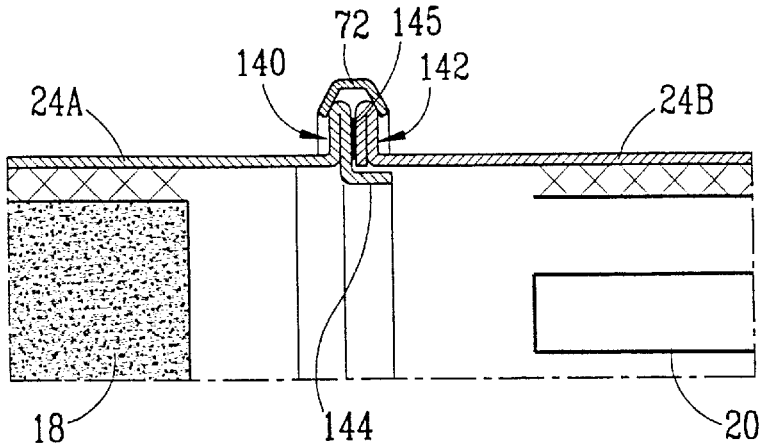

In the embodiment shown in FIG. 3E, each of the two flanges 140, 142 at the respective ends of the sections 24A, 24B is an external peripheral flange perpendicular to the common axis of the sections 24A, 24B. These flanges are obtained by bending the metal on itself. One flange 140 is extended by an internal guide ring 144 which centers the two sections 24A, 24B by virtue of being received in the passage at the end of the section 24B. A gasket 145 is disposed between the two flanges 140, 142.

The inclined flanges 84, 86 of the clip 72 bear directly on the perimeter of the flanges 140, 142. It presses them together in the axial direction by virtue of a cam effect obtained when the clip is tightened.

Figure 3F:
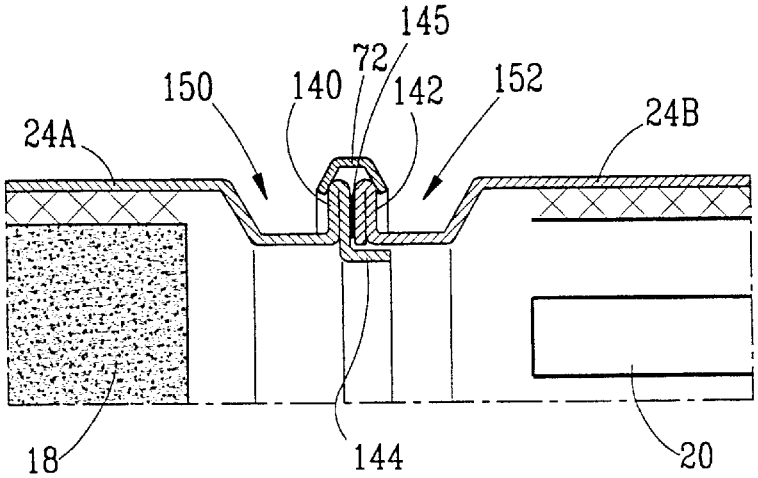

The embodiment shown in FIG. 3F differs from that shown in FIG. 3E only in that the flanges 140, 142 are formed immediately after constrictions 150, 152 reducing the overall transverse dimensions of the removable connecting means.

Figure 3G:
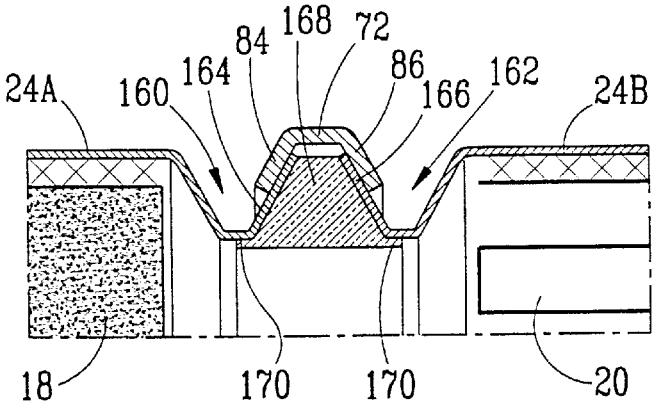

In the embodiment shown in FIG. 3G the ends of the sections 24A, 24B have constrictions 160, 162 extended by a frustoconical ring 164, 166 forming a flange. The flanges converge in the direction toward their outward facing free edge. Their inclination is identical to that of the flanges 84, 86 of the clip 72.

A trapezium-shape cross section O-ring 168 is disposed between the sections 24A, 24B. It has beveled edges whose inclinations correspond to those of the flanges 164, 166, against whose inside faces it is pressed. The O-ring 168 has annular lips 170 along its inside perimeter on each side for centering the two sections 24A, 24B.

The clip 72 bears on the two flanges 164, 166 to press the sections 24A, 24B together and hold them in place.

FIGS. 4A to 4D show four different embodiments of the removable connecting means 66 at the level of the interruption 62.

Figure 4A:
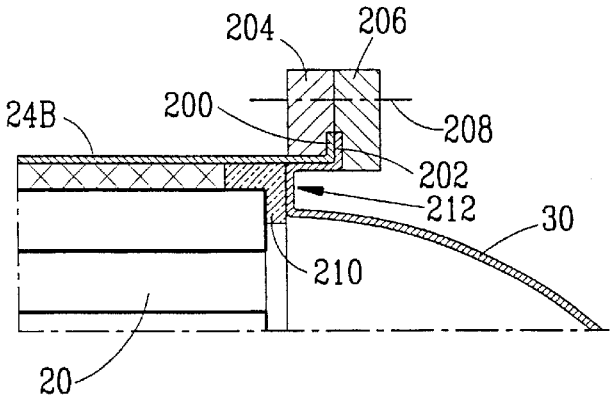
FIGS. 4A, 4B, 4C and 4D are partial views in section of variants of the interruption in the exhaust box from FIG. 2 immediately downstream of the particle filter.

In the embodiment shown in FIG. 4A, the ends of the section 24B and the convergent section 30 include external peripheral flanges 200, 202 on which bear annular clamping rings 204, 206 pressed together by a set of bolts 208 around the perimeter of the interruption 62. A seal 210 which retains the filter in the axial direction is disposed between the wall of the section 24B, the particle filter and a re-entrant annular deformation 212 of the periphery of the convergent section 30, to the rear of the flange 202.

Figure 4B:
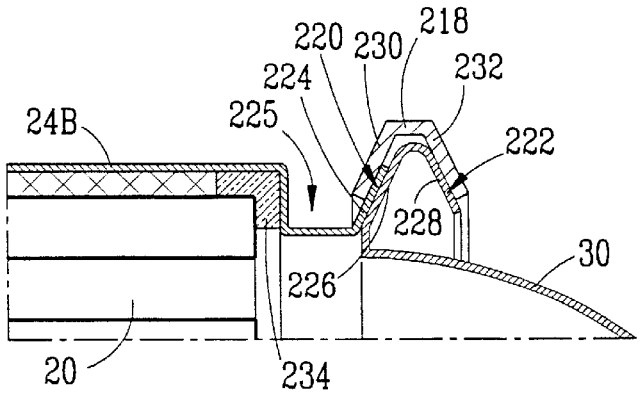
Figure 4C:
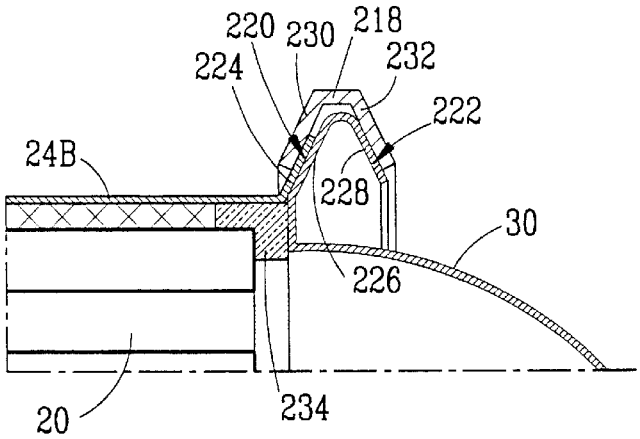
Figure 4D:
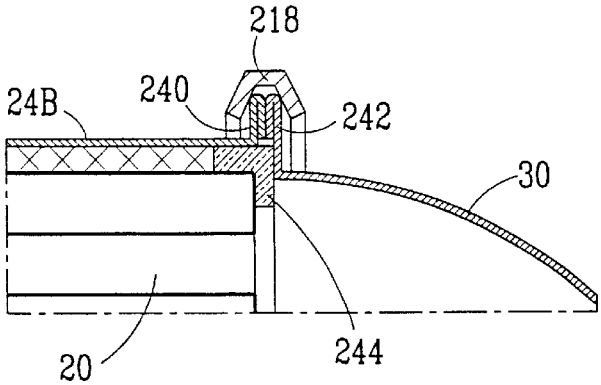

In the embodiments shown in FIGS. 4B, 4C and 4D, the section 24B and the convergent section 30 have outside peripheral deformations at their end forming flanges adapted to be pressed together and held in place by a removable clip 218 similar to the clip 72.

In the embodiment shown in FIG. 4B, the flanges 220, 222 at the ends of the respectively sections 24B and 30 have respective corresponding and identically inclined frustoconical bearing surfaces 224, 226. The bearing surface 224 is formed at the end of a constriction 225.

The bearing surface 226 is extended by a bent back section 228 delimiting a frustoconical bearing surface facing in the opposite direction. The bearing surfaces 220 and 228 therefore converge in the radially outward direction. Flanges 230, 232 of the clip 218 bear on them.

A seal 234 which retains the filter axially is disposed between the particle filter 20 and the shoulder delimited by the constriction 225.

The embodiment shown in FIG. 4C differs from the embodiment shown in FIG. 4B only in that there is no constriction 225. The flange 220 is therefore outside an extension of the cylindrical wall defining the section 24B. In this embodiment, the seal 234 retaining the filter in the axial direction is pressed against the convergent section 30.

In the embodiment shown in FIG. 4D, the two end flanges 240, 242 are transverse flanges defined by bending the metal of the sections 24B and 30. A seal 244 which retains the filter axially is disposed between the particle filter 20, the wall of the section 24B and a centripetal extension of the flange 242.

The flanges 240, 242 are held together by a clip 218 which presses them together with a cam effect.

Whichever embodiment of the removable connecting means 64, 66 is used, the exhaust box shown in FIG. 2 provides direct access to most of the upstream and downstream surfaces of the particle filter once the means 64 and 66 have been removed. It is therefore easy to clean the particle filter with compressed air or by immersing it in a contraflow of liquid through the passages of the particle filter. It can also be cleaned by injecting a suitable fluid.

If the cross section of an interruption is greater than the maximum cross section of the particle filter, the filter can be changed or removed for cleaning and then replaced.

If a liquid is used to clean the filter it is advantageous to be able to separate the particle filter from the remainder of the exhaust pipe because this means that the particle filter can be dried in an oven on its own.

In an embodiment of the invention that is not shown access is provided only to the upstream side of the particle filter.

In a variant that is not shown the cross section of the catalytic purification unit 18 is less than the cross section of the particle filter 20. The jacket 24 has a staggered region between the catalytic purification unit and the particle filter containing the interruption 60 and the removable butt jointing means.

What is claimed is:

1. Device for removing pollution from exhaust gases of an internal combustion engine and having successive filtration and regeneration phases, the device including an exhaust box (12) containing, in series, a catalytic purification unit (18) and a particle filter (20) having pores of sufficiently small diameter to retain particles of soot on its upstream face during said filtration phases and enabling the particles of soot on its upstream face to be burned during said regeneration phases to form ash, and means (36; 60) providing access to the upstream face of the particle filter (20), which access means have a cross section sufficient to enable cleaning of the particle filter (20), still contained in the exhaust box, by removal of the ash which is retained on the upstream face of the filter, wherein said exhaust box comprises a cylindrical wall (24) extended on one side by a divergent section (26) connecting an inlet pipe (28), and extended on the other side by a convergent section (30) terminating in an outlet pipe (32), and wherein the filter has sufficient heat resistance so as not to be altered when the particles of soot are burned on the upstream face of the filter.

2. Device according to claim 1, characterized in that it includes means (42; 62) providing access to the downstream face of the particle filter (20).

3. Device according to claim 1, characterized in that said cylindrical wall (24) of the exhaust box (12) is a part of an exhaust box outer jacket (24, 26, 30) delimiting an exhaust gas flow passage across which are disposed the catalytic purification unit (18) and the particle filter (20), and in that said access means include an orifice (36, 42) in the outer jacket (24, 26, 30) opening opposite a corresponding surface of the particle filter (20) and a removable cap (40, 46) for blocking said access orifice (36, 42).

4. Device according to claim 1, characterized in that said cylindrical wall (24) the exhaust box (12) is a part of an exhaust box outer jacket (24, 26, 30) delimiting an exhaust gas flow passage across which are disposed the catalytic purification unit (18) and the particle filter (20) and in that said access means include a transverse interruption (60, 62) of the outer jacket (24, 26, 30) extending all around its periphery, which interruption (60, 62) separates the outer jacket into two successive sections (24A, 24B; 24B, 30), and removable connecting means for butt jointing two successive sections (24A, 24B; 24B, 30) at said interruptions (60, 62).

5. Device according to claim 4, characterized in that the removable connecting means include, at the facing ends of each section (24A, 24B; 24B, 30), peripheral flanges (68, 70; 110, 118; 140, 142; 164, 166; 220, 222; 240, 242) and a clip (72; 218) for axially clamping the two flanges together.

6. Device according to claim 5, characterized in that said peripheral flanges (68, 70; 110, 118; 140, 142; 164, 166; 220, 222; 240, 242) are deformed ends of the successive sections (24A, 24B; 24B, 30).

7. Device according to claim 4, characterized in that the removable connecting means include a clamping ring (94, 96; 204, 206) attached to the end of each section (24A, 24B 24B, 30) arid bolts (98; 208) for clamping the two clamping rings (94, 96; 204, 206).

8. Device according to claim 4, characterized in that a free cross section of the transverse interruption (60, 62) is more than 60% of a cross section of a corresponding face of the particle filter (20).

9. Device according to claim 8, characterized in that the free section of the transverse interruption (60, 62) is greater than a maximum section of the particle filter (20), to enable the latter to be removed.

10. Device according to claim 4, characterized in that the removable connecting means include a seal (77; 99; 120; 145; 168) disposed between the two successive section (24A, 24B).

11. Use, in a device for removing pollution from exhaust gases of an internal combustion engine which has successive filtration and regeneration phases, of an exhaust box (12) containing:

a catalytic purification unit (18) and a particle filter (20) disposed in series, the particle filter being adapted to retain particles of soot on its upstream face during said filtration phases and to enable the particles of soot on its upstream face to be burnt during said regeneration phases to form ash, and means (36; 60) providing access to the upstream face of the particle filter (20), the access means having a cross section suited to cleaning of the particle filter to enable removal of the ash retained on the upstream face of the particle filter still contained in the exhaust box.

* * * * *